US009689405B1

(12) United States Patent
Mizukami

(10) Patent No.: US 9,689,405 B1
(45) Date of Patent: Jun. 27, 2017

(54) HYDRAULIC ACCUMULATOR

(71) Applicant: NHK SPRING CO., LTD., Yokohama, Kanagawa (JP)

(72) Inventor: Hiroshi Mizukami, Kanagawa (JP)

(73) Assignee: NHK SPRING CO., LTD., Yokohama, Kanagawa (JP)

( * ) Notice: Subject to any disclaimer, the term of this patent is extended or adjusted under 35 U.S.C. 154(b) by 0 days.

(21) Appl. No.: 15/172,414

(22) Filed: Jun. 3, 2016

(51) Int. Cl.
*F16L 55/04* (2006.01)
*F15B 1/08* (2006.01)

(52) U.S. Cl.
CPC ..... *F15B 1/08* (2013.01); *F15B 2201/205* (2013.01)

(58) Field of Classification Search
USPC ..... 138/30, 31
See application file for complete search history.

(56) References Cited

U.S. PATENT DOCUMENTS

| | | | | |
|---|---|---|---|---|
| 7,325,571 | B2 * | 2/2008 | Shimbori | F15B 1/106 138/30 |
| 7,770,599 | B2 * | 8/2010 | Ota | F15B 1/103 138/26 |
| 8,365,772 | B2 * | 2/2013 | Arikawa | F15B 1/103 138/30 |
| 2003/0116209 | A1 * | 6/2003 | Umetsu | F15B 1/103 138/31 |
| 2011/0226370 | A1 | 9/2011 | Arikawa et al. | |
| 2014/0224368 | A1 * | 8/2014 | Yamashita | F15B 1/103 138/31 |
| 2014/0311604 | A1 * | 10/2014 | Yoshihara | F15B 1/08 138/30 |

FOREIGN PATENT DOCUMENTS

| | | |
|---|---|---|
| JP | 2003-172301 A | 6/2003 |
| JP | 2010-127332 A | 6/2010 |
| JP | 2012-237415 A | 12/2012 |
| JP | 2015-028872 | 2/2015 |

OTHER PUBLICATIONS

Extended European Search Report corresponding to European Patent Application No. 16172377.0, dated Dec. 6, 2016.

* cited by examiner

*Primary Examiner* — James Hook
(74) *Attorney, Agent, or Firm* — Squire Patton Boggs (US) LLP

(57) ABSTRACT

A hydraulic accumulator includes a shell, a bellows, and a self-seal stay disposed at a hydraulic-fluid inlet and including a cylindrical body portion open to a hydraulic chamber and a lid-shaped head portion defining a through hole. The self-seal stay includes a first weakened portion for deforming the body portion when a pressure of the gas chamber is more than a given threshold. The first weakened portion includes a first recessed portion formed in a circumferential direction of the body portion. The first recessed portion includes a bottom surface of a plane surface or a circular arc shaped curved surface which is convex toward outside of the body portion from inside thereof. At least one of both end portions of the bottom surface in the circumferential direction is joined with an outer circumferential surface of the body portion.

7 Claims, 12 Drawing Sheets

HYDRAULIC ACCUMULATOR

CROSS-REFERENCE TO RELATED APPLICATIONS

This application is based upon Japanese Patent Application No. 2015-028872 filed on Feb. 17, 2016; the entire contents of which are incorporated herein by reference.

BACKGROUND OF THE INVENTION

The invention relates to a hydraulic accumulator, and particularly relates to a hydraulic accumulator including a self-seal stay with a weakened portion.

An automobile's brake circuit or the like has a hydraulic circuit, which employs a hydraulic accumulator for temporarily storing fluid increased in pressure. The hydraulic accumulator includes a gas chamber in which a gas of a high pressure is sealed, and a fluid chamber in which a hydraulic fluid (hydraulic oil) is introduced. The gas chamber and the fluid chamber are arranged opposite to each other relative to an expandable and contractable bellows. Expanding and contracting of the bellows makes the pressure of the gas chamber and the pressure of the fluid chamber balance with each other, which prevents pulsation of the hydraulic circuit to regulate it to an appropriate hydraulic pressure.

In a conventional hydraulic accumulator, for example, if an automobile is subjected to a fire or the like and placed under a high temperature or high pressure circumstance for a long time, the inner pressure of the gas chamber in the hydraulic accumulator can excessively increase. For this reason, the hydraulic accumulator includes a relief means which releases the inner pressure of the gas chamber when it is placed under such an abnormal situation. Refer to patent document 1: Patent Application Publication Laid-open No. 2003-172301 and patent document 2: Patent Application Publication Laid-open No. 2012-237415.

The patent document 1 describes a hydraulic accumulator provided with a weakened portion which serves as a relief means for releasing inner pressure of the gas chamber and is formed by reducing a thickness of the sidewall of the stay disposed in the fluid chamber (refer to paragraph [0017] and FIG. 1). In the hydraulic chamber, when the inner pressure of the gas chamber excessively increases, the excessively increased inner pressure of the gas chamber causes the bellows to be pressed and the inner pressure of the fluid chamber to be increased, thereby breaking the weakened portion.

Then, breaking the weakened portion makes hydraulic fluid of a high pressure discharged from the fluid chamber to decrease the pressure in the fluid chamber. The excessively increased inner pressure of the gas chamber causes the bellows to be intentionally broken to release the inner pressure of the gas chamber from the communication hole formed in the head portion of the stay.

The patent document 2 describes a hydraulic accumulator formed with a shapedly weakened portion, which serves as a relief means for releasing then inner pressure of the gas chamber and is simultaneously formed during press forming of the metal-made stay. This shapedly weakened portion causes the metal-made stay to be buckled to further securely release liquid and gas in the shell (refer to claims 1 and 2, paragraph [0009], and FIGS. 2 to 8).

In the hydraulic accumulator described in the patent document 1, however, when the weakened portion is broken to release the inner pressure of the gas chamber, breaking suddenly occurs. This causes explosive sound at the breaking, resulting in sense of anxiety. When the weakened portion is broken, the inner pressure is released excessively instantaneously. This makes it difficult to regulate a relief pressure for releasing pressure in the gas chamber. If the hydraulic accumulator tries to be downsized, the stay of a low height enhances its rigidity, which makes it difficult to break the stay.

In the hydraulic accumulator described in the patent document 2, if formation accuracy and thickness accuracy try to be strictly ensured, the number of steps for working a mold and the number of adjustments increase, while it is difficult to regulate relief pressure for releasing the pressure in the gas chamber.

The first object of the invention is to reduce the number of steps for fabricating a hydraulic accumulator with a simple construction.

The second object of the invention is to facilitate regulating a relief pressure for releasing pressure in a gas chamber.

The third object of the invention is to release a high pressure gas in a gas chamber at a proper timing.

The fourth object of the invention is to properly control a relief pressure of the high-pressure gas.

SUMMARY OF THE INVENTION

An aspect of the invention provides a hydraulic accumulator. The hydraulic accumulator includes a shell including an internal portion defining a gas chamber and a fluid chamber; a bellows expandably and contractably housed in the shell and partitioning the internal portion into the gas chamber and the fluid chamber; a port portion disposed on the shell and defining a hydraulic-fluid inlet open to the fluid chamber; and a self-seal stay disposed at the port portion and including a cylindrical body portion and a lid-shaped head portion defining a through hole. The head portion is one with which an end portion of the bellows comes into contact. The self-seal stay includes a first weakened portion for deforming the body portion to incline the head portion relative to the end portion of the bellows when a pressure of the gas chamber is more than a given threshold. The first weakened portion including a first recessed portion formed in a circumferential direction of the body portion. The first recessed portion includes a bottom surface of a plane surface or a circular arc shaped curved surface which is convex toward outside of the body portion from inside thereof. At least one of both end portions of the bottom surface in the circumferential direction is joined with an outer circumferential surface of the body portion.

In the hydraulic accumulator, the first weakened portion includes the first recessed portion formed in the circumferential direction of the body portion, which makes productivity excellent and management of dimensional accuracy easier. This is capable of preferably setting a relief pressure for releasing pressure in the gas chamber.

The hydraulic accumulator includes the first weakened portion of the first recessed portion, which makes it easy for buckling to occur on the body portion of the self-seal stay in a range of forming the first recessed portion. Therefore, when the pressure and the temperature of a high-pressure gas in the gas chamber excessively increase, this securely induces buckling, which makes the high-pressure gas in the gas chamber securely released at a proper timing. Especially, downsizing of the hydraulic accumulator makes height of the self-seal stay smaller, which makes it difficult for the self-seal stay to buckle. This is preferable for downsizing the hydraulic accumulator.

That is, if the pressure or temperature of the gas chamber is more than a given threshold, the pressure of the gas chamber for pressing against the head portion induces buckling on the body of the self-seal stay, and the body portion is deformed such that the head portion inclines to the end portion of the bellows. Therefore, the through hole formed in the head portion of the self-seal stay comes in contact with the end portion of the bellows to be opened from a closed state, thereby enabling the high-pressure gas in the gas chamber to be released through the through hole.

In the hydraulic accumulator, the bottom surface is formed of a plane surface or a circular arc shaped curved surface, and at least one of both the end portions of the bottom surface in the circumferential direction is joined with the outer circumferential surface of the body portion, so that a thickness of body portion at the bottom surface of the first recessed portion increases from the central portion of the bottom surface of the first recessed portion to said at least one of both the end portions. Therefore, an initial buckling occurs on the central portion of the recessed portion in the circumferential direction of the body portion, and this initial buckling triggers buckling which develops to the at least one of both the end portions of the first recessed portion.

The degree of buckling indicates the property that the axial flexure of the body portion is larger at the central portion of the first recessed portion and smaller at the at least one of both the end portions of the first recessed portion.

That is, since buckling at the central portion of the first recessed portion is induced at a proper timing, the buckling develops over the whole first recessed portion so as to extend in the circumferential direction. For this, a given necessary time difference from occurrence of the buckling to completion of it is set. Therefore, the high-pressure gas in the gas chamber is gently released from the through hole formed in the head portion of the self-seal stay with taking a given necessary time.

The hydraulic accumulator properly regulates a release pressure of the high-pressure gas. This regulation avoids explosive release in which a high-pressure gas is suddenly and instantaneously discharged, thereby effectively preventing explosive noise and shock from occurring at releasing of the high-pressure gas.

In this way, the hydraulic accumulator reduces the number of steps for fabrication with a simple construction. Also, the hydraulic accumulator facilitates regulating a relief pressure for releasing the pressure in the gas chamber. The hydraulic accumulator releases the high-pressure gas in the gas chamber at a proper timing. In addition, the hydraulic accumulator properly regulates the relief pressure of the high-pressure gas, and thereby effectively prevents noise or the like from occurring at releasing of the high-pressure gas.

The first recessed portion may have in the circumferential direction a length of a groove which is approximately half of a circumferential length of the body portion.

The length of the groove of the first recessed portion having approximately half of a circumferential length of the body portion makes an axial support rigidity appropriately set, thereby facilitating occurrence of buckling at a proper timing.

The first weakened portion may include a second weakened portion extending from the first recessed portion in an axial direction of the body portion.

Providing the first weakened portion with the second weakened portion makes an axial support rigidity of the first recessed portion further appropriately set, which facilitates occurrence of buckling at a proper timing.

The above hydraulic accumulator reduces the number of steps for fabrication with the simple construction. Also, the hydraulic accumulator facilitates regulating a relief pressure for releasing the pressure in the gas chamber. The hydraulic accumulator releases the high-pressure gas in the gas chamber at a proper timing. In addition, the hydraulic accumulator properly regulates the relief pressure of the high-pressure gas, and thereby effectively prevents noise and shock from occurring at releasing of the high-pressure gas.

BRIEF DESCRIPTION OF THE ACCOMPANYING DRAWINGS

FIG. 3A is a plane section view taken along IIIA-IIIA of FIG. 3A, FIG. 3B is an elevational section view taken along IIIB-IIIB of FIG. 3C, and FIG. 3C is a perspective view;

Figure 1:
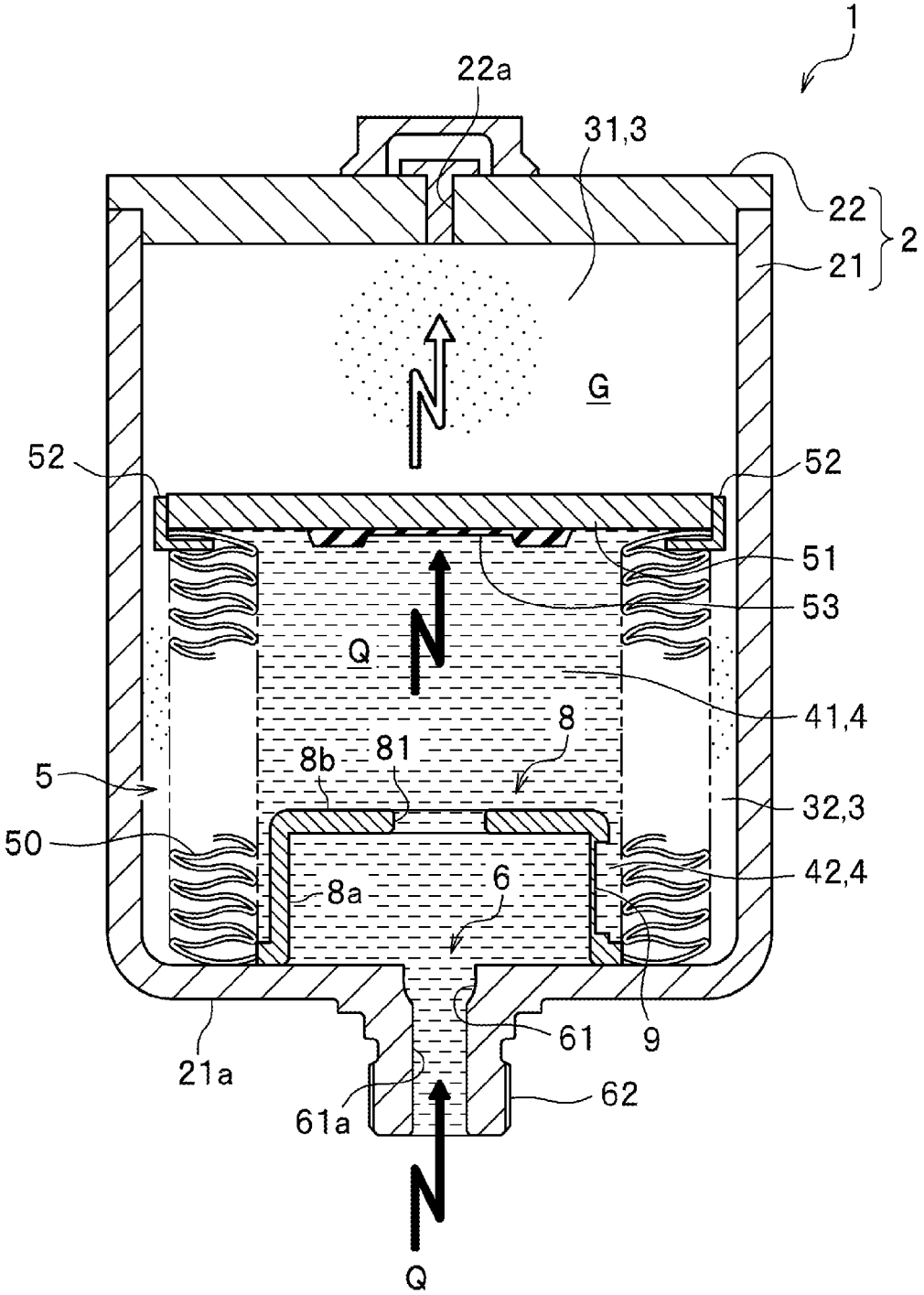
FIG. 1 is an elevational section view illustrating a hydraulic accumulator according to an embodiment of the invention.
Figure 4A:
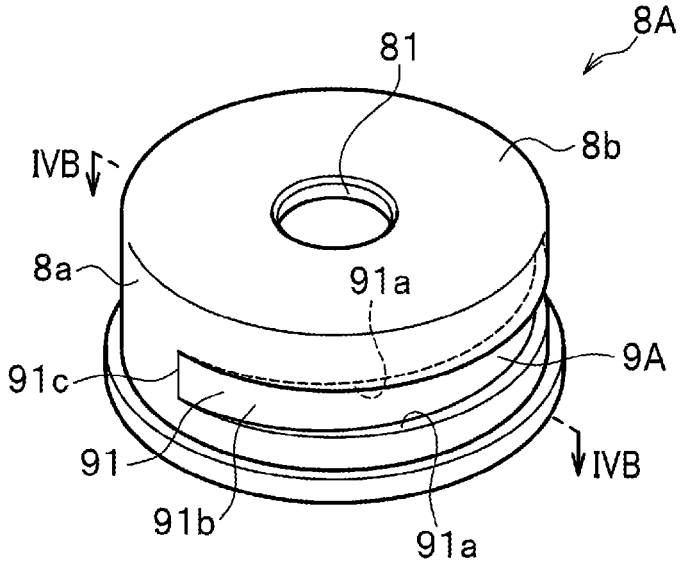
Figure 4B:
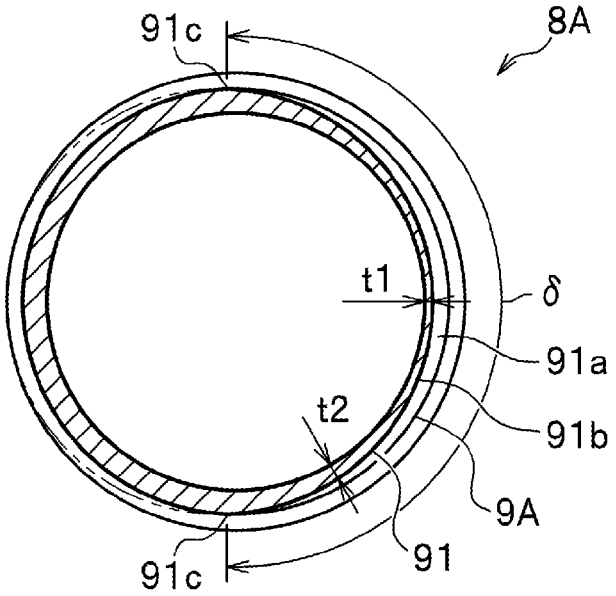
Figure 5A:
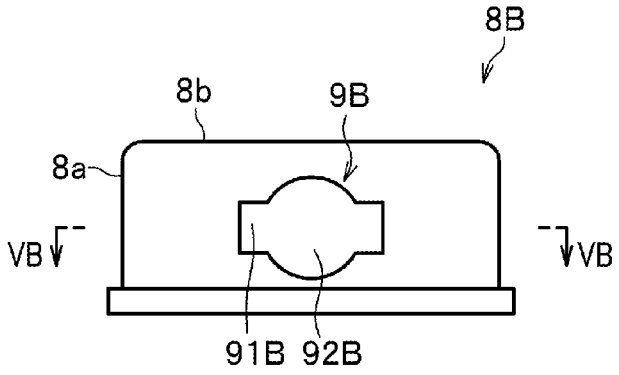
Figure 5B:
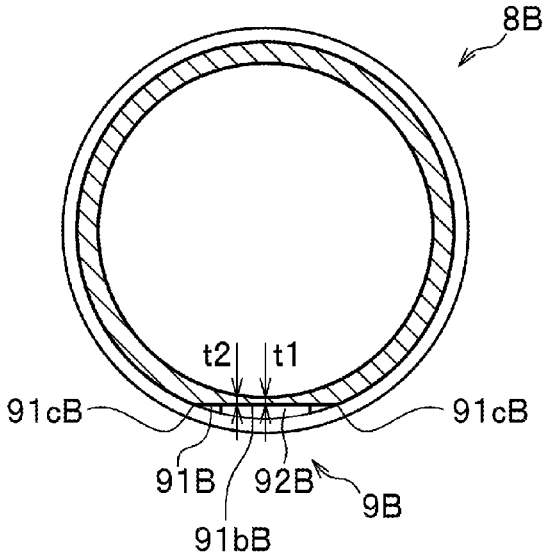
Figure 5C:
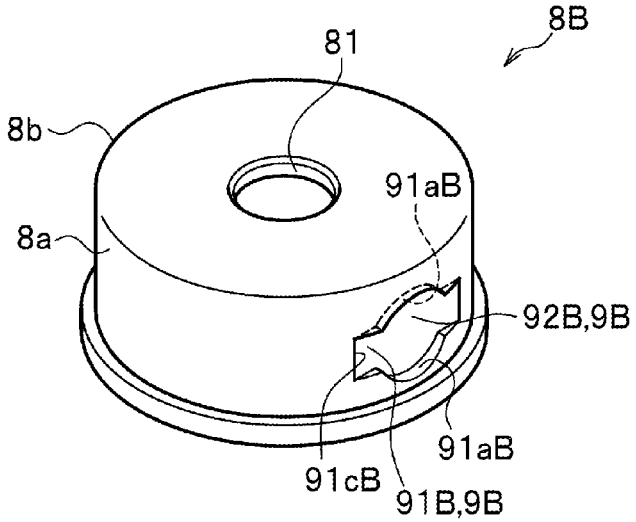
Figure 6A:
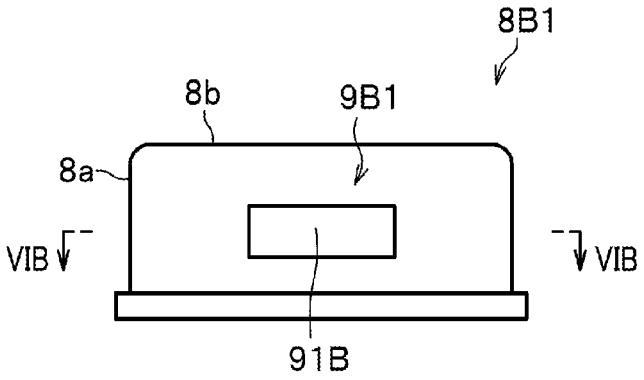
Figure 6B:
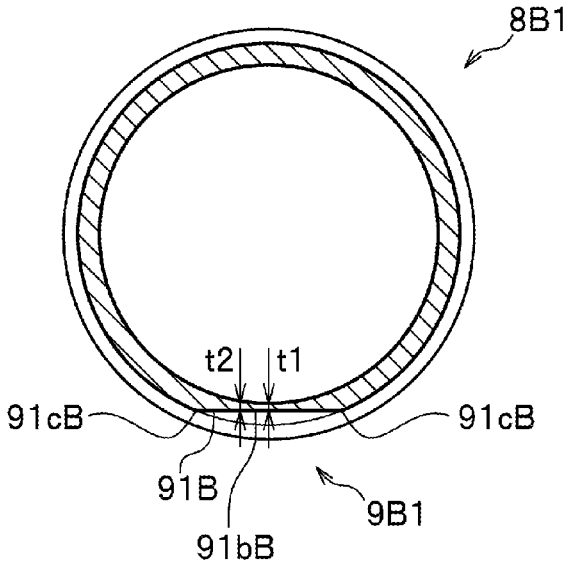
Figure 6C:
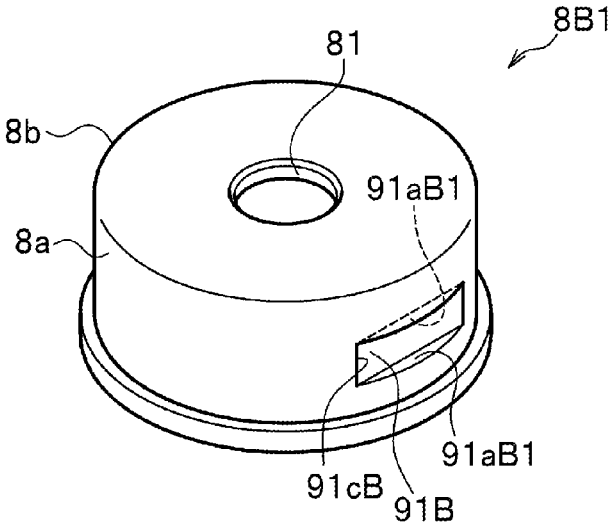
Figure 7:
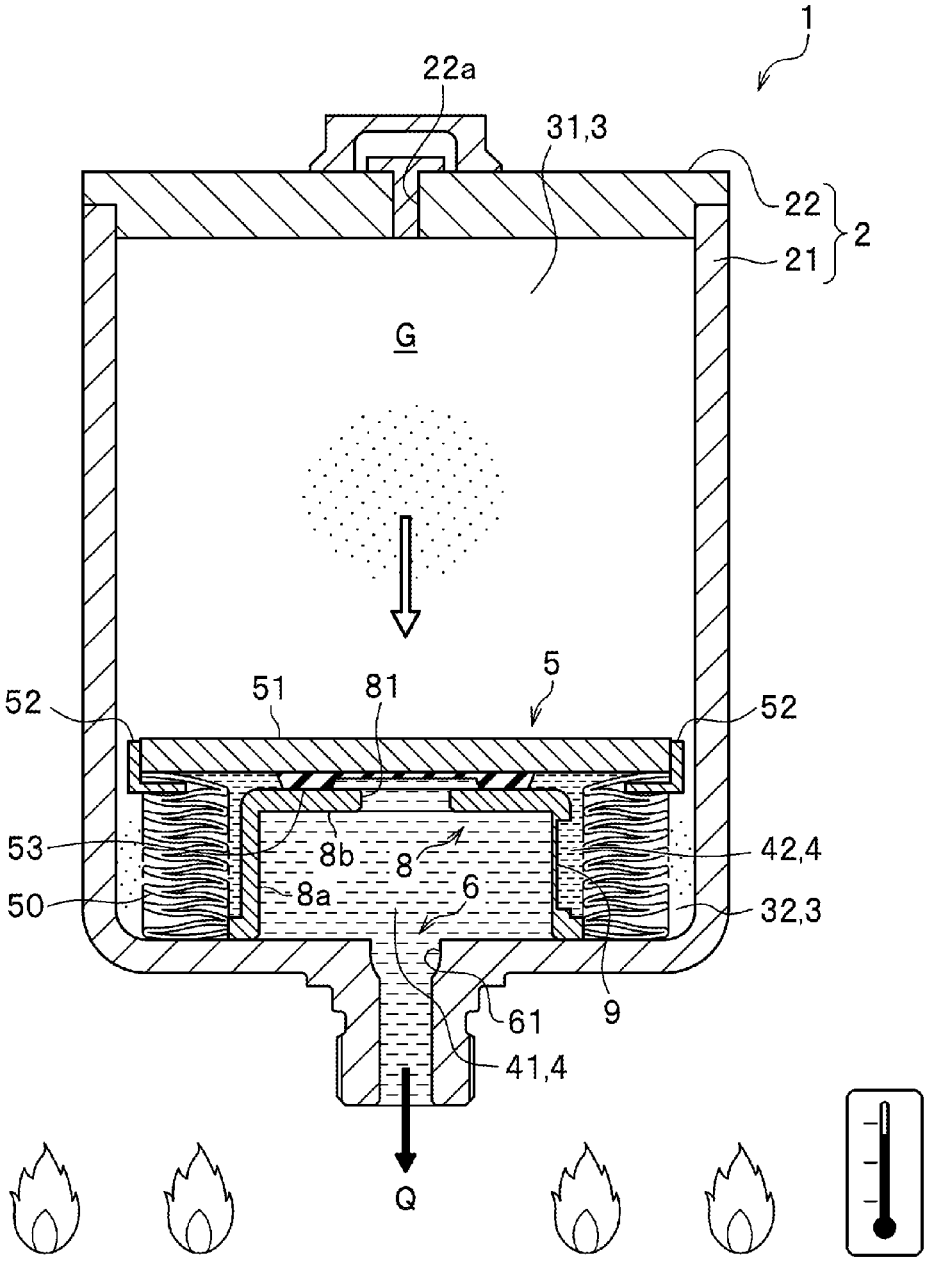
Figure 8:
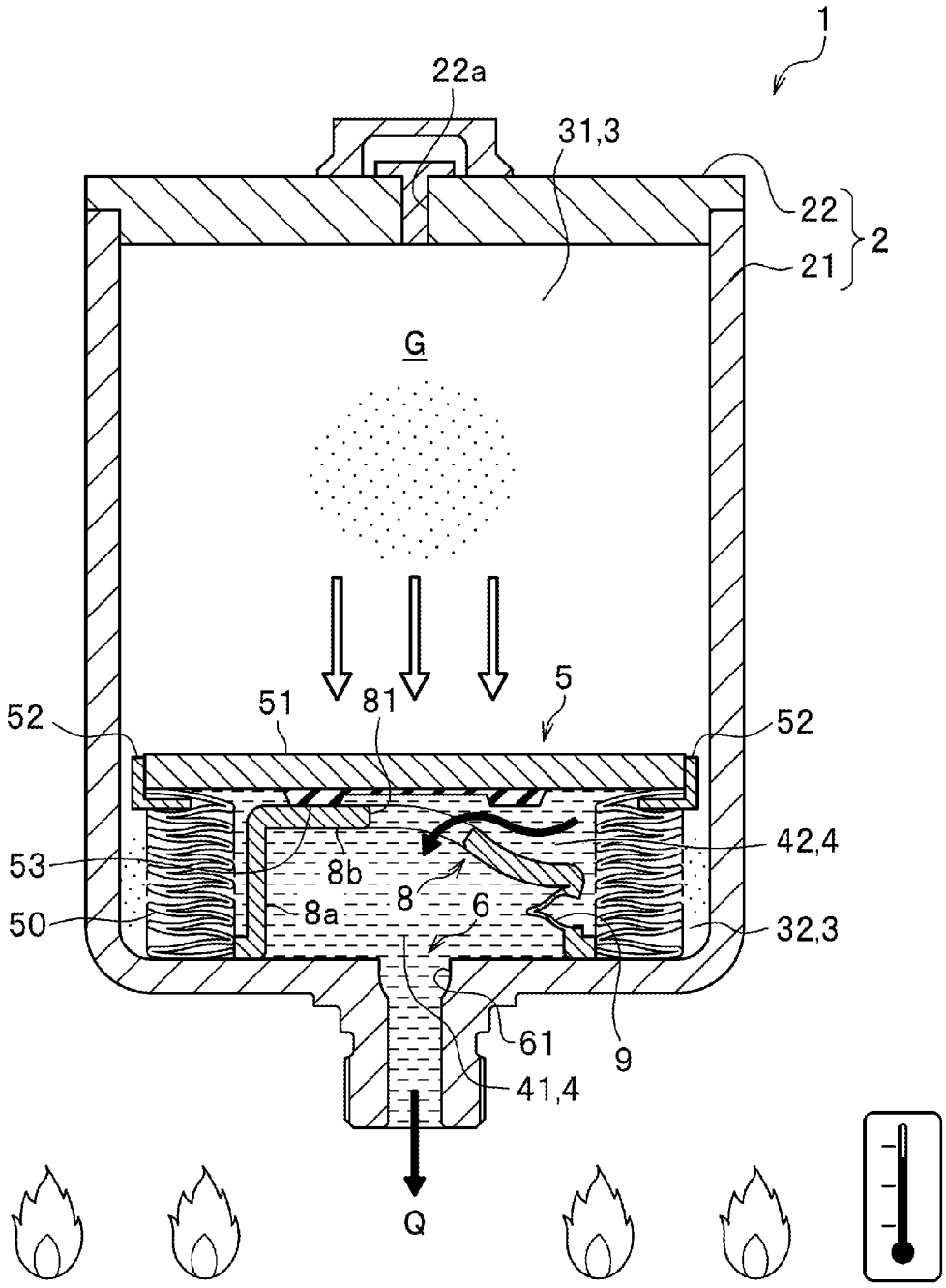
Figure 9:
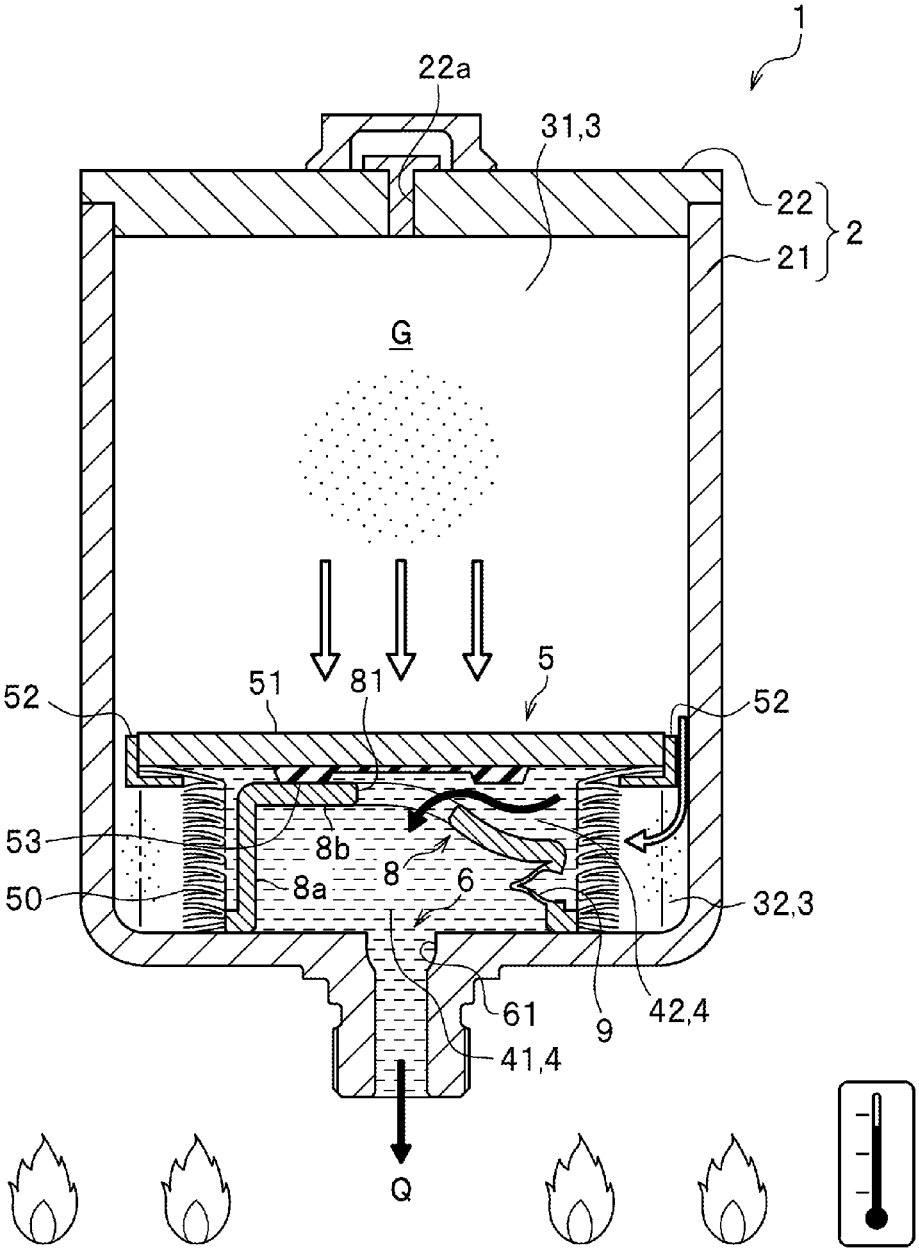
Figure 10:
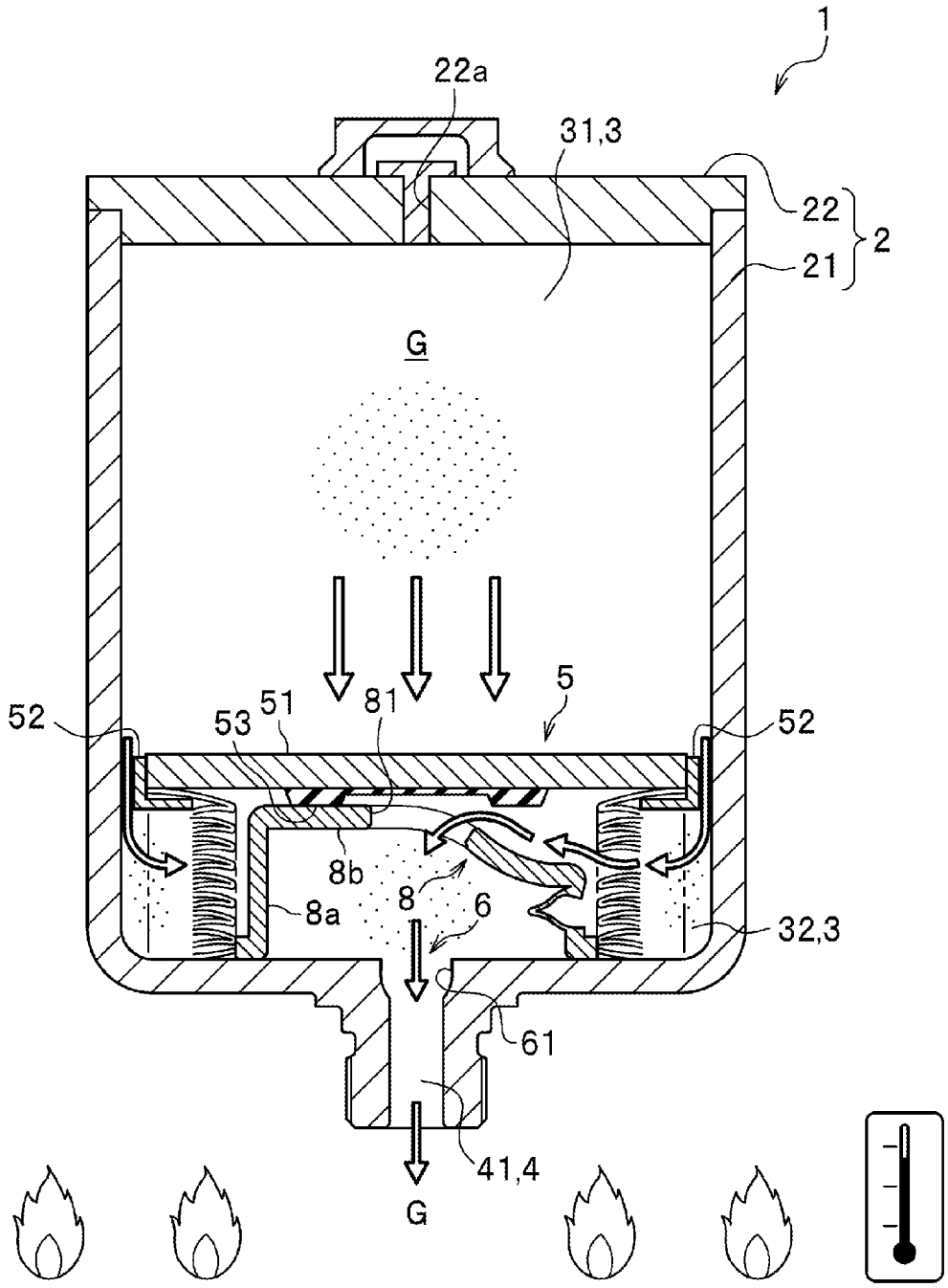
Figure 11A:
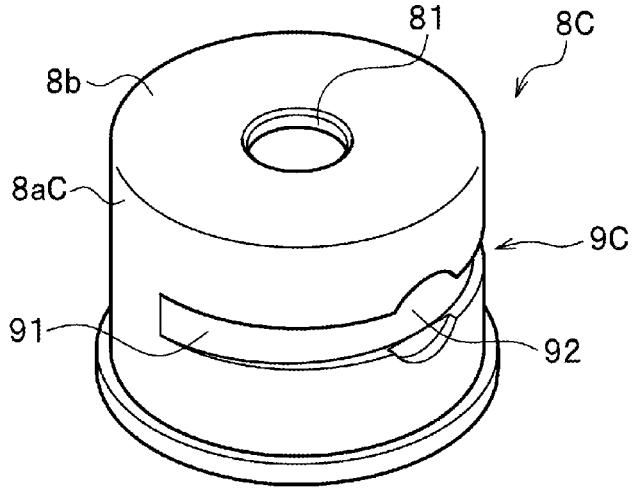
Figure 11B:
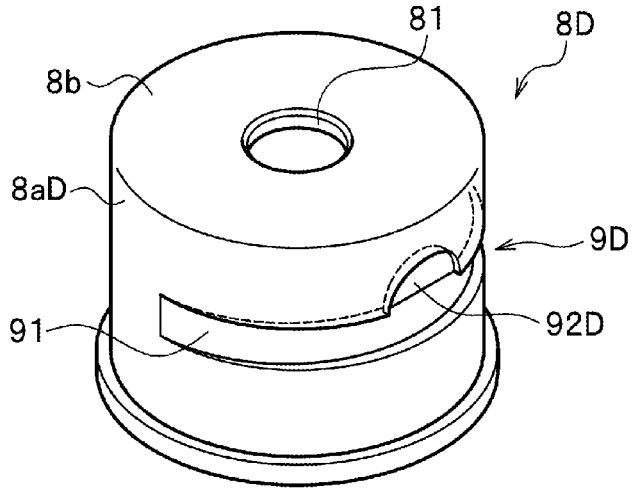
Figure 11C:
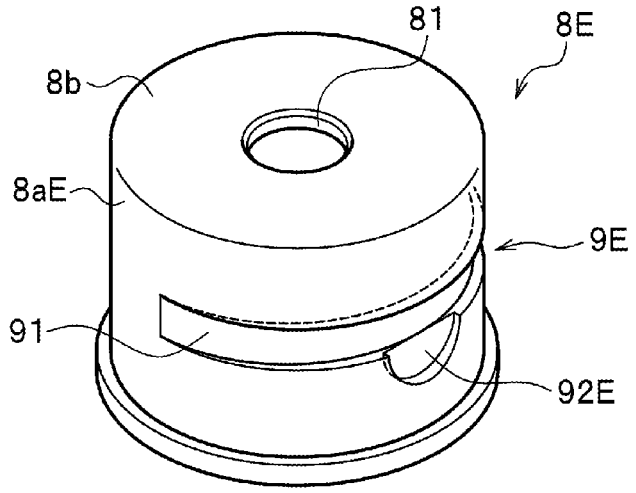
Figure 12:
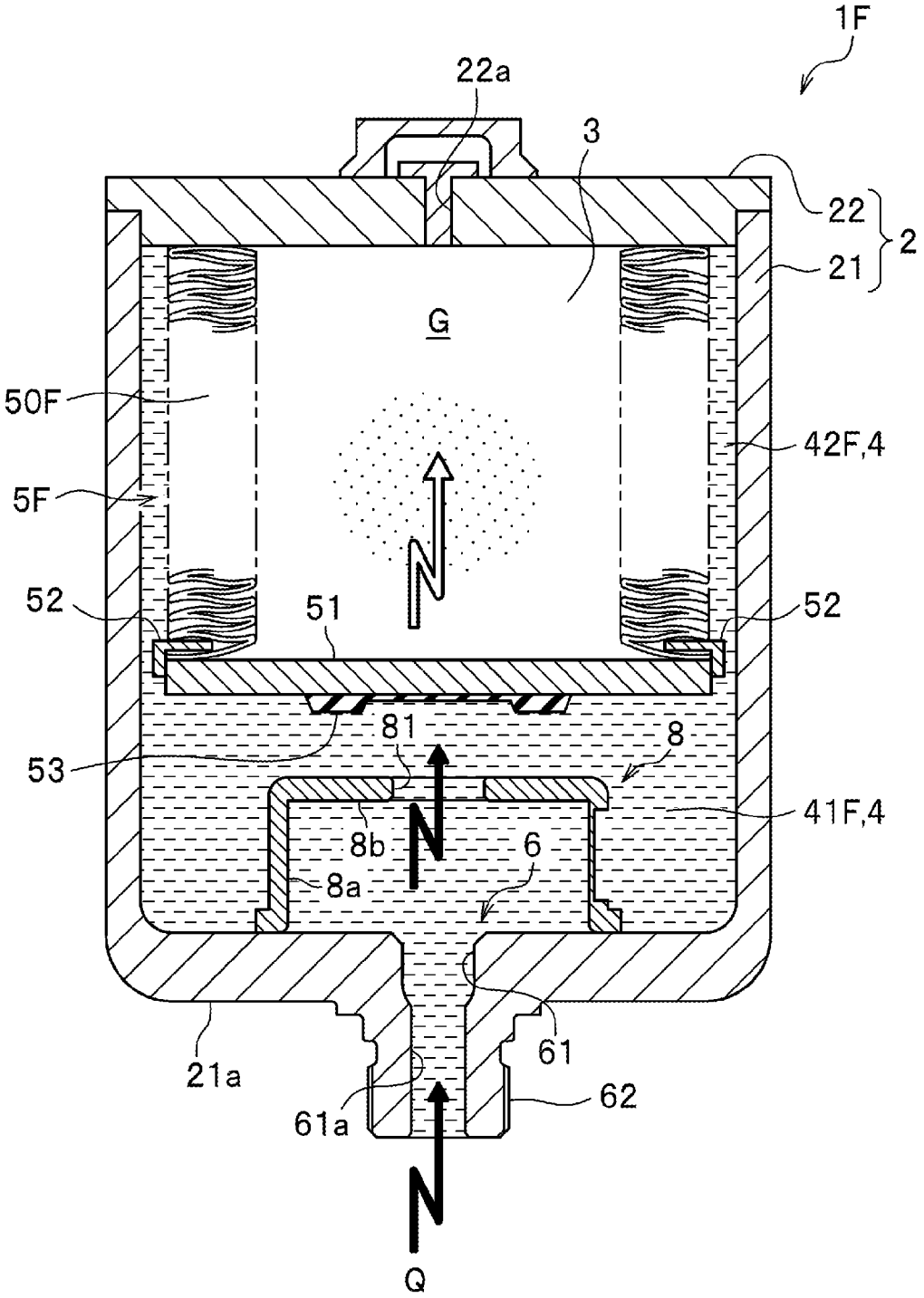

FIGS. 4A and 4B are views illustrating a first modification of the self-seal stay as illustrated in FIG. 1, FIG. 4A is a perspective view, and FIG. 4B is a plane section view taken along IVB-IVB of FIG. 4A, FIGS. 5A to 5C are views illustrating an example 1 of a second modification of the self-seal stay as illustrated in FIG. 1, FIG. 5A is an elevational view, FIG. 5B is a section view taken along VB-VB of FIG. 5A, and FIG. 5C is a perspective view;

FIGS. 6A to 6C are views illustrating an example 2 of the second modification of the self-seal stay illustrated in FIG. 1, FIG. 6A is an elevational view, FIG. 6B is a section view taken along VIB-VIB of FIG. 6A, and FIG. 6C is a perspective view;

FIG. 7 is an elevational view which illustrates a motion, during an abnormal operation, of the hydraulic accumulator illustrated in FIG. 1 and an initial stage in which it is placed under a fire or the like, and pressure and temperature in a gas chamber increase so that a hydraulic-fluid inlet is closed;

FIG. 8 is an elevational section view which illustrates a motion, during an abnormal operation, of the hydraulic accumulator illustrated in FIG. 1 and a state in which temperature and gas pressure in the gas chamber further increase to a given threshold so that the self-seal stay is buckled;

FIG. 9 is an elevational section view which illustrates a motion, during an abnormal operation, of the hydraulic accumulator illustrated in FIG. 1 and a state in which the pressure of a second hydraulic chamber decreases so that a bellows is broken;

FIG. 10 is an elevational section view which illustrates a condition, during an abnormal operation, of the hydraulic accumulator illustrated in FIG. 1, in which a high-pressure gas in the gas chamber is released;

FIGS. 11A to 11C are perspective views illustrating third modifications of the self-seal stay illustrated in FIG. 1, FIG. 11A is an example of a self-seal stay with a longer axial length, FIG. 11B is an example of a self-seal stay with an auxiliary weakened portion of FIG. 11A positioned close to a head portion, and FIG. 11C is an example of a self-seal stay with the auxiliary weakened portion of FIG. 11A positioned close to a bottom portion; and FIG. 12 is an elevational section view illustrating a hydraulic accumulator according to a fourth modification of the hydraulic accumulator illustrated in FIG. 1.

DESCRIPTION OF THE EMBODIMENTS

The detailed description will be given of a construction of a hydraulic accumulator 1 according to an embodiment of the invention, referring to FIGS. 1 to 5C as necessary.

The hydraulic accumulator, as illustrated in FIG. 1, includes a shell 2 of a pressure container, a gas chamber 3 and a fluid chamber 4 formed inside the shell 2, the gas chamber 3 having a high-pressure gas G sealed therein, the fluid chamber 4 having hydraulic fluid Q introduced from a hydraulic circuit such as a brake circuit not illustrated, a bellows 5 expandably and contractably housed in the shell 2, a port portion 6 of the shell 2 formed with a hydraulic-fluid inlet 61 open to the fluid chamber 4, and a self-seal stay 8 disposed in the fluid chamber 4 and covering the port portion 6.

The bellows 5 is a partition member which serves as a boundary between the gas chamber 3 and the fluid chamber 4. The bellows 5 includes an expansion-contraction portion 50 formed as bellows, an end portion 51 fixed to the end of the expansion-contraction portion 50, bellows guides 52 formed in a piece shape and supporting slidably the expansion-contraction portion 50, and a seal member 53 disposed on the end portion 51 (underside on FIG. 1).

The self-self stay 8 is formed in a cap shape of a lower height and includes a cylindrical body portion 8*a* and a lid-shaped head portion 8*b*. The self-seal stay 8 includes a through hole 81 formed at the central portion of the head portion 8*b*, and a weakened portion 9 formed on the body portion 8*a*.

The self-seal stay 8 has a function of limiting an expansion volume of the gas chamber 3 and supporting the bellows 5 so as not to be excessively compressed.

In such a constructed hydraulic accumulator 1, when the bellows 5 contracts, the seal member 53 closes the through hole 81 of the self-seal stay 8. In the self-seal stay 8 with the weakened portion 9, when the pressure in the gas chamber 3 is more than a given threshold, the pressure in the gas chamber 3 causes the body portion 8*a* to be deformed and collapsed such that the head portion 8*b* inclines to the end portion 51 of the bellows 5

Figure 2:
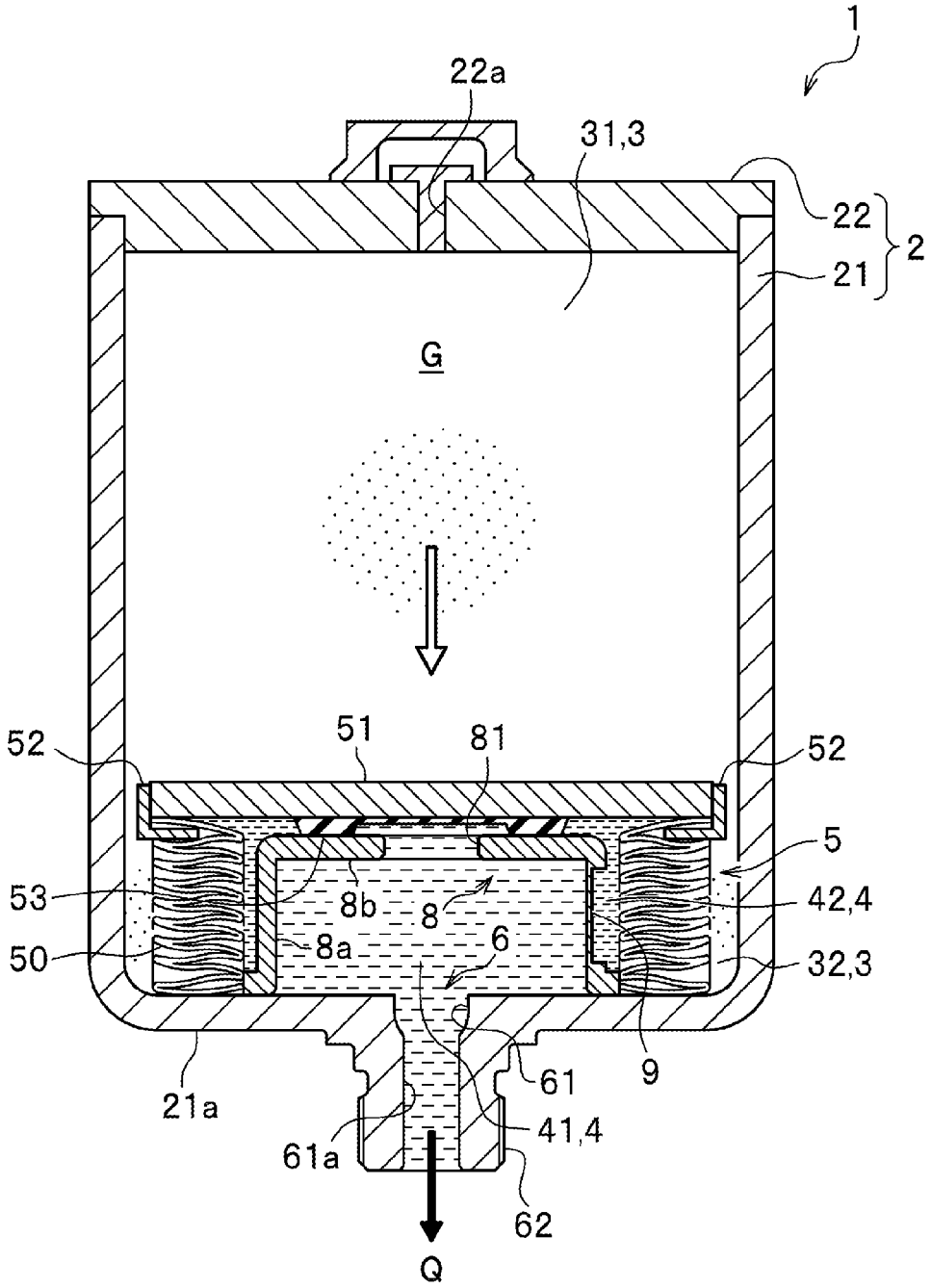
FIG. 2 is an elevational section view which illustrates a motion, during a normal operation, of the hydraulic accumulator illustrated in FIG. 1 and a state where hydraulic pressure of a hydraulic circuit decreases and a hydraulic-fluid inlet is closed.

In the below explanation, a motion of the hydraulic accumulator 1 in a range of an expected motion is referred to as a "motion during a normal operation" (FIGS. 1 and 2). In the case that a fire or the like causes the pressure and the temperature of the gas chamber 3 to excessively increase so that the pressure in the gas chamber 3 is excessively higher than a given pressure (a pressure in a range of a presupposed motion) during a normal operation, this motion state is referred to as an "motion during an abnormal operation" to be distinguished from one during the normal operation for convenience of explanation (FIGS. 7 to 10).

<Motion During Normal Operation>

In the hydraulic accumulator 1, expanding and contracting of the bellows 5 makes pressures of the gas chamber 3 and the fluid chamber 4 balance with each other, which prevents the pulsation of a hydraulic circuit (not illustrated) of a brake circuit or the like to regulate it to an appropriate hydraulic pressure.

As illustrated in FIG. 2, when the hydraulic pressure of the hydraulic circuit (not illustrated) decreases to make the pressure in the fluid chamber 4 relative to the pressure of the gas chamber 3 lower than a preset given pressure, the seal member 53 comes into contact with the head portion 8*b* of the self-seal stay 8 to close the through hole 81 formed in the head portion 8*b* of the self-seal stay 8, thereby preventing the hydraulic pressure of the hydraulic circuit (not illustrated) from decreasing.

<Shell>

The shell 2, as illustrated in FIG. 1, is a pressure container with a sealed structure. The shell 2 includes a cylindrical body portion 21 having a bottom portion 21*a*, a lid plate 22 welded to the opening end of the body portion 21, and a gas filling inlet 22*a* disposed in the lid plate 22.

It is noted that though a part of a member in the embodiment employs a term which means a vertical relationship such as a "bottom portion 21*a*" or a "lid plate 22", this term means a positional relationship in the Figures for convenience of explanation, and is not for the purpose of specifying a positional relationship in the use condition.

<Gas Chamber>

The gas chamber 3 is a space enclosed mainly with the bellows 5, the lid plate 22, and the body portion 21 of the shell 2. The gas chamber 3 is formed on a lid 22 side in the axial direction of the shell 2 (an end portion side opposite to the port portion 6), and a high-pressure gas G is filled therein from the gas filling inlet 22*a*. The gas chamber 3 includes a first gas chamber 31 formed above the bellows 5, and a second gas chamber 32 formed on a outer circumferential wall side of the bellows 5 (outside of the circumferential wall, serving as a boundary, of the bellows 5). The first gas chamber 31 and the second gas chamber 32 communicate with each other and have equal pressures respectively.

<Fluid Chamber>

The fluid chamber 4, as illustrated in FIG. 2, includes, with the through hole 81 of the self-seal stay 8 closed, a first fluid chamber 41 formed on the inside of the self-seal stay 8 (hydraulic-fluid inlet 61 side), and a second fluid chamber 42 formed on the outside of the self-seal stay 8 (inside of the circumferential wall, serving as a boundary, of the bellows 5).

The first fluid chamber 41 is a region inside the self-seal stay 8, which is enclosed mainly by the self-seal stay 8 and the bottom portion 21*a* of the shell 2.

The second fluid chamber 42 is a region interposed mainly between the inner circumferential wall of the bellows 5 and the outside of the self-seal stay 8.

As illustrated in FIG. 1, hydraulic fluid Q (hydraulic oil) is introduced into the first fluid chamber 41 from the hydraulic circuit (not illustrated) of the brake circuit or the like through the hydraulic-fluid inlet 61 formed in the port portion 6. The hydraulic fluid Q flows through clearances formed on the both sides of a bellows guide 52 of a piece shape to be filled up to the second chamber 42.

Therefore, during the normal operation, with the through hole 81 of the self-seal stay 8 not closed, the first fluid chamber 41 and the second fluid chamber 42 communicate with each other via the through hole 81, and the respective pressures are equal to each other.

On the other hand, with the through hole 81 of the self-seal stay 8 closed, as illustrated in FIG. 2 the seal member 53 prevents the first fluid chamber 41 and the second fluid chamber 42 from communicating with each other. Therefore, the first fluid chamber 41 communicates with the hydraulic circuit not illustrated, while the second fluid chamber 42 serves as an independent sealed chamber.

Therefore, during the normal operation, even if the pressure of the hydraulic circuit (not illustrated) decreases to make the pressure of the first chamber 41 lower than the pressure of the gas chamber 3, the pressure of the second fluid chamber 42 is kept to make the pressure of the gas chamber 3 and the pressure of the second fluid chamber 42 balance with each other, thereby preventing damage of the bellows 5.

<Bellows>

The expansion-contraction portion 50 of the bellows 5 is an expansion-contraction member which is formed in a bellows and circular shape and has a hollow internal portion. The expansion-contraction portion 50 is a metal member which bears against the internal pressure of the high-pressure gas G. The expansion-contraction portion 50 includes one end (lower end of FIG. 1) which is in tight contact with the bottom portion 21*a* of the shell 2 and is hermetically fixed on it, and the other end (upper end of FIG. 1) which is in tight contact with the end portion 51 and is fixed on it so as to render the inside hermetic.

The end portion 51 of the bellows 5 is a disk-shaped member to seal the opening portion of the head portion of the bellows 5, and may be constituted by a so-called bellows cap.

The bellows 5 operates so as to expand in an axial direction under a gas pressure in the gas chamber 3 sealed above the bellows 5 and on the outer circumferential wall side of the bellows 5. The bellows 5 operates so as to contract to the inner circumferential wall side of the bellows 5 under a hydraulic pressure of the fluid introduced from the hydraulic circuit (not illustrated). Thereby, the bellows 5 expands and contracts to make the gas pressure and hydraulic pressure balance with each other to prevent the pulsation of hydraulic circuit (not illustrated), thereby regulating the hydraulic fluid to a given hydraulic pressure.

The bellows guides 52 are piece-shaped sliding members each having an L-shaped section for reducing friction resistance. The bellows guides 52 are fixed on the outer circumferential end of the end portion 51 fixed to the expansion-contraction portion 50. The bellows guides 52 are equally arranged at two to four positions on a circle with appropriate clearances, so that the bellows 5 is capable of smoothly expanding and contracting and the first gas chamber 31 and the second gas chamber 32 communicate with each other.

<Seal Member>

The seal member 53 employs an elastic member such as a rubber for enhancing hermetic ability during a normal operation. It is noted that though under an excessive high-temperature and high-pressure state the seal member 53 is fused or carbonized to lose its sealability, it is not especially limited to it.

<Port Portion>

The port portion 6 is a portion which is formed integrally with the bottom portion 21*a* of the shell 2 and includes the circumference of the hydraulic-fluid inlet 61. The port portion 6 includes a body portion 62 connected to the hydraulic circuit (not illustrated) by a pipe arrangement and a joint not illustrated; and a hydraulic-fluid flow passage 61*a* which extends through the body portion 62 and the bottom portion 21*a* of the shell 2 and communicates with the hydraulic-fluid inlet 61.

It is noted that though the port portion 6 forming a port portion of the shell 2 is formed integrally with the shell 2 in view of stiffness and hermetic ability or the like, it is not limited to this. For priority of the workability or the like, a port member (not illustrated) separate from the shell 2 may be fixed on the shell 2. In the case of the port member provided as a separate member, a fixation means such as welding ensures the hermetic ability and the port member is fixed on the shell 2.

<Self-Seal Stay>

Figure 3A:
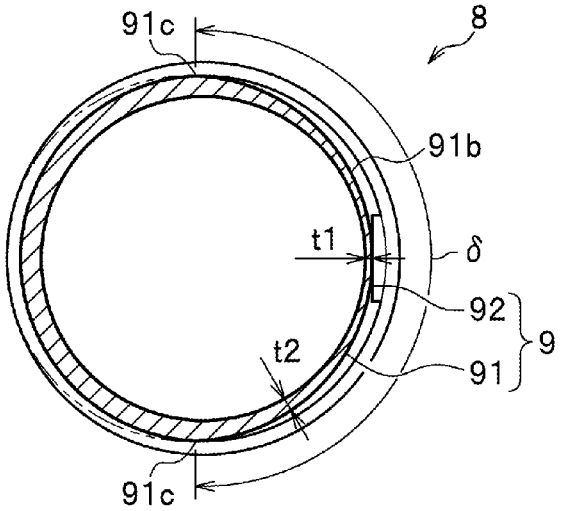
FIGS. 3A to 3C illustrate a self-seal stay as illustrated in FIG. 1.
Figure 3B:
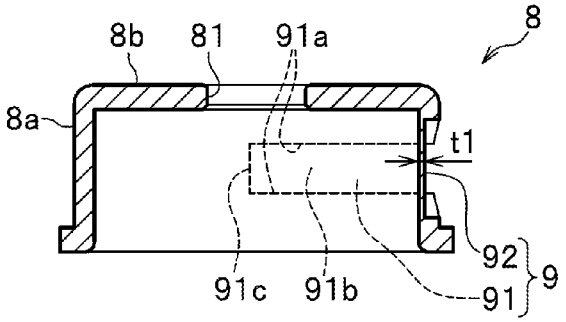
Figure 3C:
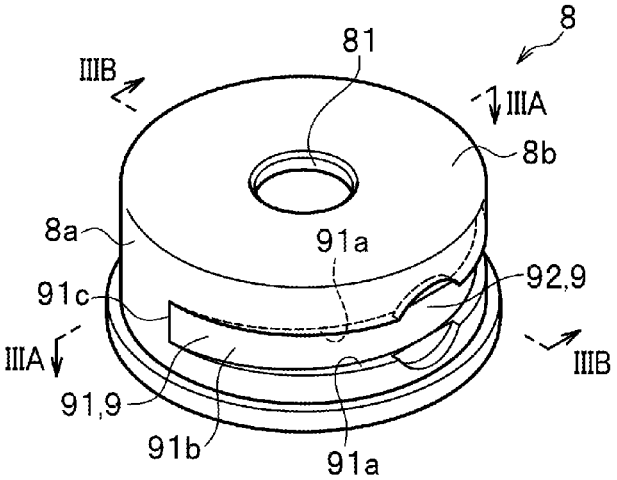

The self-seal stay 8, as illustrated in FIGS. 3A to 3C, includes a thin weakened portion 9 on the body portion 8*a* (first weakened portion). In the self-seal stay 8, when the pressure of the gas chamber 3 is more than a given threshold, pressure of the gas chamber 3 for pressing against the head portion 8*b* and the pressure of the second fluid chamber 42 for pressing against the body portion 62 cause the weakened portion 9 of the body portion 8*a* to be collapsed under pressure. When the body portion 8*a* is collapsed by the weakened portion 9 under pressure, the head portion 8*b* inclines to the end portion 51 of the bellows 5. This makes the through-hole 81 formed in the head portion 8*b* of the self-seal stay 8 opened.

<Weakened Portion>

The weakened portion 9 includes a groove-shaped recessed portion 91 of a primary weakened portion formed in a circumferential direction of the body portion 8*a*; and an auxiliary weakened portion 92 (second weakened portion) of a back-facing-hole shape.

The groove-shaped recessed portion 91 (first recessed portion) is a belt-shaped groove formed at approximately the central portion in the vertical direction of the body portion 8*a*. The groove has a length δ in the circumferential direction of the body portion 8*a* (refer to FIG. 3A), which is approximately half length of the circumferential length (whole circumferential length) of the body portion 8*a*. This "approximately half length" includes a half length, and means a length a little longer than the half and a length a little shorter than the half.

This construction ensures the groove length δ up to the approximately half of the circumferential length of the body portion 8*a*, and appropriately sets an axial support rigidity at the central portion of the groove, thereby facilitating occurrence of buckling at a proper timing.

The grove-shaped recessed portion 91 includes paired sidewall portions 91*a* and 91*a* facing each other; and a bottom surface 91*b* formed between the sidewall portions 91*a* and 91*a*.

The bottom surface 91*b* of the recessed portion 91 has a curved surface of a circular arc shape which is convex from the inside of the body portion 8*a* to the outside thereof. The bottom surface 91*b* includes both the circumferential end portions 91*c* which pass through to or reach the outer circumferential surface of the body portion 8*a*.

Therefore, both the end portions 91*c* do not have any thickness-directional steps at the boundary between the outer circumferential surface and the bottom surface 91*b* of the recessed portion 91, and the bottom surface 91*b* is smoothly integrated or joined with the outer circumferential surface of the body portion 8*a*. That is, both the end portions 91*c* and the outer circumferential surface of the body portion 8*a* are continuous with each other.

The curved surface of the bottom surface 91*b* in the recessed portion 91 is larger in curvature radius than the outer circumferential surface of the body portion 8*a*. It is noted that at least one of both the end portions 91*c* in the circumferential direction of the bottom surface 91*b* may join with the outer circumferential surface of the body portion 8*a*.

According to the construction, thickness t1 of the body portion 8*a* at the central portion of the recessed portion 91 in the circumferential direction is smaller, each thickness t2 of both the end portions 91*c* of the recessed portion 91 is gradually larger than that of the central portion, and each thickness of the both the end portions 91*c* are equal to that of the body portion 8*a*.

The auxiliary weakened portion 92 is a recessed portion which is formed such that it extends from the recessed portion 91 along the outer circumferential portion of the body portion 8*a* in the axial direction so as to overlap with the groove-shaped recessed portion 91. To be specific, the auxiliary weakened portion 92 has a back-facing-hole shape with a bottom which is formed to the groove-shaped recessed portion 91 at the central portion in the circumferential direction and the axial direction. As illustrated in FIG. 3A, the auxiliary weakened portion 92 of a back-facing-hole shape has a bottom surface having a central portion of a thickness t1 (refer to FIG. 3B).

<First Modification>

It is noted that though the present embodiment the weakened portion 9 is constituted with two configurations of the primary weakened portion and the auxiliary weakened portion, it is not limited to this. It may be only the recessed portion 91 of the primary weakened portion (refer to FIGS. 4A and 4B).

As illustrated in FIGS. 4A and 4B, though the self-seal stay 8A according to the first modification differs from the self-seal stay 8 (FIGS. 3A to 3C) in not including the auxiliary weakened portion 92 (FIG. 3A to 3C), the other components are the same and the redundant explanations are omitted.

Whether or not the auxiliary weakened portion 92 is provided is appropriately determined by considering the shape of the self-seal stay and setting pressure of the gas chamber 3 or the like. Provision of the auxiliary weakened portion 92 further appropriately sets the groove-shaped recessed portion 91 to an axial support rigidity, thereby facilitating occurrence of buckling at a proper timing.

<Second Modification>

In the present embodiment, though the bottom surface 91*b* of the groove-shaped recessed portion 91 is formed with a circular arc-shaped curved surface, it is not limited to this. As illustrated in FIGS. 5A to 5C and FIGS. 6A to 6C, in order to reduce the number of steps of fabrication the bottom surface may be not a curved surface but a plane surface.

As illustrated in FIGS. 5A to 5C, the self-seal stay 8B according to an example 1 of the second modification includes a groove-shaped recessed portion 91B, which includes paired sidewall portions 91*a*B and 91*a*B facing each other; and a bottom surface 91*b*B of a plane surface formed between the sidewall portions 91*a*B and 91*a*B. The auxiliary weakened portion 92B has the same configuration, and the specific explanations are omitted.

It is noted that though the self-seal stay 8B according to the example 1 of the second modification includes the auxiliary weakened portion 92B, the self-seal stay 8B 1 according to the example 2 of the second modification illustrated in FIGS. 6A to 6C may not be provided with the auxiliary weakened portion 92B.

Though the self-seal stay 8B 1 according to the example 2 of the second modification differs from the self-seal stay 8B according to the example 1 of the second modification in not including the auxiliary weakened portion 92B, the other components are the same, and the same components are attached with the same characters and the redundant explanations are omitted.

The bottom surface 91*b*B of the recessed portion 91B, as illustrated in FIGS. 5B and 6B, is a plane surface formed perpendicular to the radial direction in plane view. Both the end portions 91*c*B in a circumferential direction of the bottom surface 91*b*B pass through to or reach the outer circumferential surface of the body portion 8*a*. Therefore, both the end portions 91*c*B do not have any thickness-directional steps at the boundaries between the outer circumferential surface and the bottom surface 91*b*B of the recessed portion 91B, and the bottom surface 91*b*B is smoothly integrated or joined with the outer circumferential surface of the body portion 8*a*. That is, both the end portions 91*c*B are continuous with the outer circumferential surface of the body portion 8*a*.

According to the construction, thickness t1 of the body portion 8*a* at the central portion of the recessed portion 91B in the circumferential direction is smaller, each thickness t2 of both the end portions 91*c*B of the recessed portion 91B is gradually larger than that of the central portion, and each thickness of the both the end portions 91*c*B are equal to that of the body portion 8*a*.

<Motion During Abnormal Operation>

The description will be given of a motion during an abnormal operation of the hydraulic accumulator 1 (including the first and second modifications) with reference to FIGS. 7 to 10.

[Closing Hydraulic-Fluid Inlet by Temperature Increase]

During the abnormal operation of the hydraulic accumulator 1, as illustrated in FIG. 7, at the initial stage when a fire or the like causes the pressure and temperature of the gas chamber 3 to increase, the bellows 5 contracts downward in FIG. 7.

When the seal member 53 disposed on the bottom surface of the end portion 51 of the bellows 5 comes into contact with the head portion 8*b* of the self-seal stay 8, the seal member 53 closes the through hole 81 formed in the head portion 8*b* of the self-seal stay 8, thereby putting the hydraulic-fluid inlet 61 into a closed state. At this time, the first fluid chamber 41 has a pressure equal to that of the hydraulic circuit (not illustrated) of the brake circuit or the like not illustrated, while the second fluid chamber 42 is put in a sealed state.

[Pressure Collapsing and Buckling of Weakened Portion]

When the pressure and the temperature increase from the initial stage and the pressure in the gas chamber 3 reaches a given threshold, as illustrated in FIG. 8 the weakened portion of the self-seal stay 8 is collapsed under pressure, thereby inducing buckling on the body portion 8*a*. In other word, the weakened portion 9 is designed such that when the pressure in the gas chamber 3 reaches preset given threshold, the weakened portion 9 is collapsed under pressure, thereby inducing buckling on the body portion 8*a*. At this time, the buckling occasionally causes the weakened portion 9 to be broken.

[Decreasing of Pressure in Second Fluid Chamber]

When the weakened portion 9 is collapsed under pressure to induce buckling on the body portion 8*a*, the through hole 81 is opened. The hydraulic fluid Q in the sealed second fluid chamber 42 flows out to the first chamber 41 through the through hole 81, thereby decreasing the pressure in the second fluid chamber 42. Also, if the weakened portion 9 has a broken portion, the hydraulic fluid Q flows out from it.

[Braking of Bellows]

When the pressure in the second fluid chamber 42 decreases, as illustrated in FIG. 9 the pressure in the gas chamber 3 is larger than the pressure in the second fluid chamber 42. Therefore, the bellows 5 is broken under a pressure of the gas chamber 3 directed from the outer circumferential wall side of the bellows 5 to the hydraulic-fluid inlet 61, so that the second gas chamber 32 communicates with the second fluid chamber 42 and the first fluid chamber 41.

When the second gas chamber 32 communicates with the second fluid chamber 42 and the first fluid chamber 41, the pressure of the high-pressure gas G in the first gas chamber 31 causes the hydraulic fluid Q in the first fluid chamber 41 and the second fluid chamber 42 to flow out from the hydraulic-fluid inlet 61. As illustrated in FIG. 10, the high-pressure gas G in the first gas chamber 31 flows out from the second gas chamber 32 through the second fluid chamber 42 and the first fluid chamber 41, thereby decreasing the pressure of the high-pressure gas G in the gas chamber 3.

The above constructed hydraulic accumulator 1 according to the embodiment serves the following function and advantageous effect.

Providing the hydraulic accumulator 1 with the weakened portion 9 facilitates occurrence of buckling on the body portion 8*a* of the self-seal stay 8, thereby securely inducing buckling so that the high-pressure gas G in the gas chamber 3 is released at a proper timing. Therefore, it is preferable for the hydraulic accumulator 1 (refer to FIG. 3C) which has a height smaller than the diameter of the body portion 8*a* and makes it difficult for buckling to occur.

Providing the hydraulic accumulator 1 with the weakened portion 9 induces buckling at the central portion of the recessed portion 91 (refer to FIGS. 3A to 3C) at an initial stage. This initial buckling triggers buckling which develops to both the end portions 91*c* of the groove-shaped recessed portion 91, thereby enlarging the range of the buckling.

That is, since buckling at the central portion of the groove-shaped recessed portion 91 is induced at a proper timing, the buckling develops over the whole groove-shaped recessed portion 91 so as to extend in the circumferential direction. For this, a short given necessary time difference from occurrence of the buckling to completion of it is set. Therefore, the high-pressure gas Gin the gas chamber 3 is gently released from the through hole 81 formed in the head portion 8*b* of the self-seal stay 8 with taking a given necessary time.

Accordingly, the hydraulic accumulator 1 is capable of properly regulating a release pressure of the high-pressure gas G, and this regulation avoids explosive release in which a high-pressure gas is suddenly and instantaneously discharged, thereby effectively preventing explosive noise and shock from occurring.

It is noted that in the embodiment respective motions of the accumulator 1 are clearly separated for convenience of explanation, and are explained such that since the hydraulic fluid Q in the fluid chamber 4 is discharged, the high-pressure gas G in the gas chamber 3 flows through the fluid chamber 4 to be released. On the other hand, in fact the respective motions simultaneously proceed, and, for example, if the hydraulic pressure in the fluid chamber 4 is sufficiently decreased, the high-pressure gas G is quickly released through the hydraulic fluid Q in the fluid chamber 4.

The above description explains the embodiment of the invention. However, the invention is not limited to the above-described embodiment, but is enabled to be appropriately modified and performed. For example, as illustrated in FIG. 3C, though the self-seal stay 8 of the embodiment has a cap shape having a height smaller than the diameter of the body portion 8*a*, it is not limited to this. The configuration of the weakened portion 9 is enabled to appropriately set buckling load for inducing buckling. Therefore, as a self-seal stay 8C according to a third modification illustrated in FIG. 11A, the invention may be applied to the self-seal stay 8C having a height equal to the diameter of the body portion 8*a*.

In the embodiment illustrated in FIG. 3C, though the auxiliary weakened portion 92 is formed on the groove-shaped recessed portion 91 at the axial central portion, it is not limited to this. As a self-seal stay 8D illustrated in FIG. 11B an auxiliary weakened portion of a back-facing-hole shape may be formed on the recessed portion 91 at the upper position than the center, or as a self-seal stay 8E illustrated in FIG. 11C it may be formed at the lower position than the center.

According to such a construction, if the auxiliary weakened portion 92D is formed on the recessed portion 91 at the upper position than the center (refer to FIG. 11B), the buckling load of the auxiliary weakened portion 92D is decreased to induce buckling at an earlier stage. If the auxiliary weakened portion 92E is formed on the recessed portion 91 at the lower position than the center (refer to FIG. 11C), the buckling load of the auxiliary weakened portion 92E is increased to induce buckling at a further delayed stage.

In the embodiment illustrated in FIG. 1, though an end of the bellows 5 is fixed on the bottom portion 21*a*, it is not limited to this arrangement. As illustrated in FIG. 12, the bellows 5 may be disposed at the lid plate 22 side. In a hydraulic accumulator 1F according to a fourth modification illustrated in FIG. 12, though disposition of a bellows 5F is different, the other components and the motion are the same as those of the hydraulic accumulator 1 (refer to FIG. 1) and the specific explanation is omitted.

In the self-seal stay 8 illustrated in FIGS. 3A to 3C, though the through hole 81 is formed at the central portion of the head portion 8*b*, it is not limited to this. The through hole 81 may be offset from the central portion of the head portion 8*b* and disposed close to the circumferential central portion of the groove-shaped recessed portion 91 so as to come close to the auxiliary weakened portion 92 side.

This construction makes a buckling load set smaller to induce buckling at an earlier stage, and further smoothly accelerates flowing out of the high-pressure gas G from the through hole 81.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A hydraulic accumulator comprising:

a shell including an internal space having a gas chamber to be filled with a pressurized gas and a fluid chamber to be filled with a hydraulic-fluid;

a bellows that is extendable and contractible, installed in the shell, and partitions the internal space into the gas chamber and the fluid chamber, the bellows including a bellows cap at an end portion of the bellows;

a port portion provided to the shell and defining a hydraulic-fluid inlet communicating with the fluid chamber; and a self-seal stay disposed in the fluid chamber and comprising a cylindrical body portion surrounding the port portion; and a lid-shaped head portion defining a through hole and extending from the cylindrical body portion, the through hole being configured to be closed by the bellows cap which comes into contact with the head portion, the cylindrical body portion including a first recessed portion recessed from an outer circumferential surface of the cylindrical body portion and extending in a circumferential direction of the cylindrical body portion, the first recessed portion including a bottom surface that is plane or circular arc curved shaped; and at least one of both end portions of the bottom surface in the circumferential direction joined with the outer circumferential surface of the cylindrical body portion, the first recessed portion having a wall thickness which increases from a central portion of the first recessed portion to said at least one of the end portions of the bottom surface in the circumferential direction of the cylindrical body portion, and the first recessed portion being configured to be deformed when a gas pressure in the gas chamber is higher than a predetermined threshold.

2. The hydraulic accumulator according to claim 1, wherein the first recessed portion has in the circumferential direction a length of a groove which is approximately half of a circumferential length of the cylindrical body portion.

3. The hydraulic accumulator according to claim 1, wherein the cylindrical body portion includes a second recessed portion recessed from the outer circumferential surface of the cylindrical body portion and from the first recessed portion in an axial direction of the cylindrical body portion.

4. The hydraulic accumulator according to claim 1, wherein the bottom surface of the first recessed portion is larger in curvature radius than the outer circumferential surface of the cylindrical body portion.

5. The hydraulic accumulator according to claim 1, wherein said at least one of both the end portions of the bottom surface of the first recessed portion is continuous with the outer circumferential surface of the cylindrical body portion.

6. The hydraulic accumulator according to claim 1, wherein the wall thickness of the first recessed portion is equal to or smaller than a wall thickness of a portion, outside the first recessed portion, of the cylindrical body portion.

7. The hydraulic accumulator according to claim 6, wherein the wall thickness of the first recessed portion is a thickness in a radial direction of the cylindrical body portion, wherein the wall thickness of the portion of the cylindrical body portion is a thickness in a radial direction of the cylindrical body portion, and wherein the portion of the cylindrical body portion is outside the first recessed portion in an axial direction of the cylindrical body portion.

* * * * *